US012741718B1

(12) United States Patent
Danforth

(10) Patent No.: US 12,741,718 B1
(45) Date of Patent: Sep. 22, 2026

(54) FOLDING BULWARK ASSEMBLY AND RELATED METHODS

(71) Applicant: GG Schmitt & Sons, Inc., Sarasota, FL (US)

(72) Inventor: Scott Danforth, Bradenton, FL (US)

(73) Assignee: GG Schmitt & Sons Inc., Sarasota, FL (US)

( * ) Notice: Subject to any disclaimer, the term of this patent is extended or adjusted under 35 U.S.C. 154(b) by 439 days.

(21) Appl. No.: 18/377,285

(22) Filed: Oct. 5, 2023

Related U.S. Application Data

(60) Provisional application No. 63/378,378, filed on Oct. 5, 2022.

(51) Int. Cl.
*B63B 17/04* (2006.01)
*B63B 19/00* (2006.01)

(52) U.S. Cl.
CPC ..... *B63B 17/04* (2013.01); *B63B 19/00* (2013.01); *B63B 2017/045* (2013.01)

(58) Field of Classification Search
CPC ..... B63B 17/00; B63B 17/02; B63B 17/04; B63B 19/00; B63B 27/00; B63B 27/14
USPC ..... 114/343, 362
See application file for complete search history.

(56) References Cited

U.S. PATENT DOCUMENTS

| | | | | |
|---|---|---|---|---|
| 5,915,328 | A * | 6/1999 | Rowan | B63B 27/146 114/362 |
| 7,004,101 | B1 * | 2/2006 | Mardikian | B63B 19/08 114/362 |
| 9,120,540 | B1 * | 9/2015 | Foss | B63B 19/08 |
| 10,106,227 | B2 * | 10/2018 | Allender | B63B 17/04 |
| 10,501,151 | B2 * | 12/2019 | Allender | B63B 17/04 |

* cited by examiner

*Primary Examiner* — Lars A Olson
(74) *Attorney, Agent, or Firm* — Price Heneveld LLP

(57) ABSTRACT

A folding bulwark assembly includes a bulwark door fitted in a bulwark aperture. The door is movable between a closed position, in which the door seals the aperture, and a folded down position. A frame arrangement includes an aperture frame and a door frame, the aperture frame being mounted in the aperture and pivotably receiving a hinge shaft of the bulwark door. At least one linear actuator located in the bulwark door is operable to pivot the door between the closed position and the folded down position. A locking assembly includes a linear actuator operable to move both ends of a locking shaft into and out of locking receptacles of the aperture frame. A plurality of aperture seals are mounted to the aperture frame and provide watertight sealing therearound.

22 Claims, 5 Drawing Sheets

FOLDING BULWARK ASSEMBLY AND RELATED METHODS

CROSS-REFERENCE TO RELATED APPLICATION

This application claims priority to U.S. Provisional Patent Application Ser. No. 63/378,378 filed on Oct. 5, 2022, the contents of which are herein incorporated by reference in their entirety.

FILED OF THE INVENTION

The present invention relates to through-bulwark access mechanisms for marine vessels, and more particularly, to folding bulwarks.

BACKGROUND OF THE INVENTION

In marine vessels such as yachts having substantial bulwarks, it is generally desirably to have some means of passing through the bulwark to facilitate embarking and disembarking, as well as more easily accessing the water to enjoy jet skis, floats, snorkeling and diving activities, etc. One common means of access is a door formed in the bulwark pivoting about a vertical axis. More recently, marine vessels have started to feature "folding bulwarks"—where one or more sections of bulwark pivot about a horizontal axis. These folding bulwarks not only facilitate access across the bulwark, but are generally configured so that the inboard surface of the bulwark extends horizontally flush with the adjacent deck when folded down. Hence, the folding bulwark effectively increases available deck area.

While folding bulwarks have become very popular, from a design and integration standpoint, they are difficult to incorporate into vessel design, particularly on fiberglass vessels. To incorporate a folding bulwark, a multiple piece mold insert must be used when forming the bulwark and adjacent hull structure and multiple special components must often be separately fabricated and bonded to the hull. The aperture into which the folding bulwark is mounted often requires several adjustments to achieve a satisfactory fit, which can take weeks. Additionally, the actuators for the folding bulwark can be very difficult to access for inspection and service after final installation.

SUMMARY OF THE INVENTION

In view of the foregoing, it is an object of the present invention to provide an improved folding bulwark assembly and related methods. A folding bulwark assembly, according to an embodiment of the present invention, includes a bulwark door fitted in a bulwark aperture. The door is movable between a closed position, in which the door seals the aperture, and a folded down position. According to an aspect of the present invention, a frame arrangement includes an aperture frame and a door frame, the aperture frame being mounted in the aperture and pivotably receiving a hinge shaft of the bulwark door.

According to another aspect of the present invention, at least one linear actuator located in the bulwark door is operable to pivot the door between the closed position and the folded down position. A locking assembly includes a linear actuator operable to move both ends of a locking shaft into and out of locking receptacles of the aperture frame. A plurality of aperture seals are mounted to the aperture frame and provide watertight sealing therearound.

These and other objects, aspects and advantages of the present invention will be better appreciated in view of the drawings and following detailed description of preferred embodiments.

DETAILED DESCRIPTION OF PREFERRED EMBODIMENTS

Figure 1:
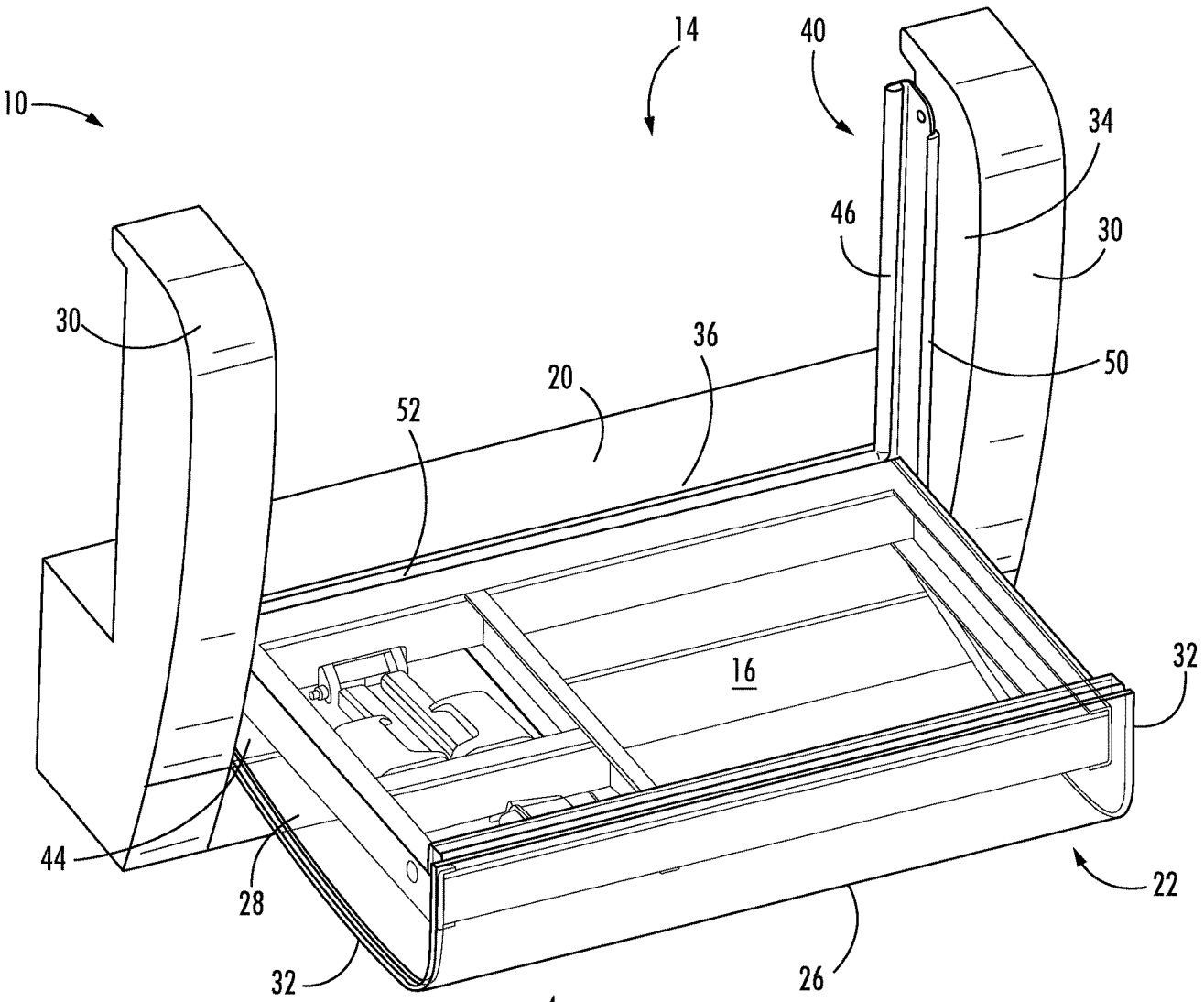
FIG. 1 is a perspective view of a folding bulwark assembly including a bulwark door fitted in a bulwark aperture, according to an embodiment of the present invention, with the door folded down.
Figure 2:
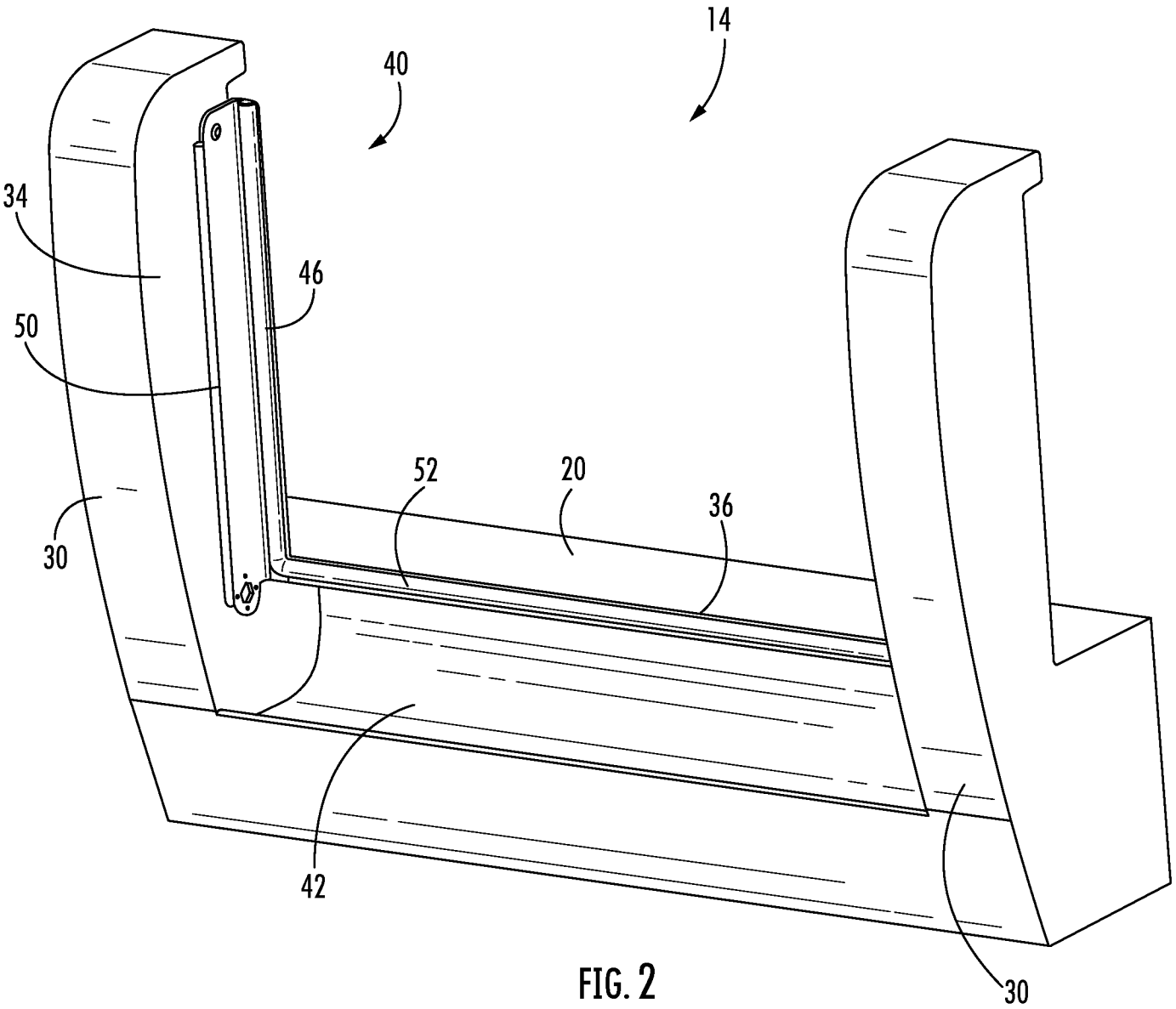
FIG. 2 is a perspective view of the folding bulwark assembly of FIG. 1, with the door removed to show details of the bulwark aperture.

According to an embodiment of the present invention, referring to FIGS. 1 and 2, a folding bulwark assembly 10 includes a bulwark door 12 fitted in a bulwark aperture 14. The door 12 is movable between a closed position, in which the door 12 seals the aperture, and a folded down position, as in FIG. 1. Advantageously, an inner surface 16 of the door 12 lies flush with an adjacent deck 20 with the door 12 folded down.

Figure 5:
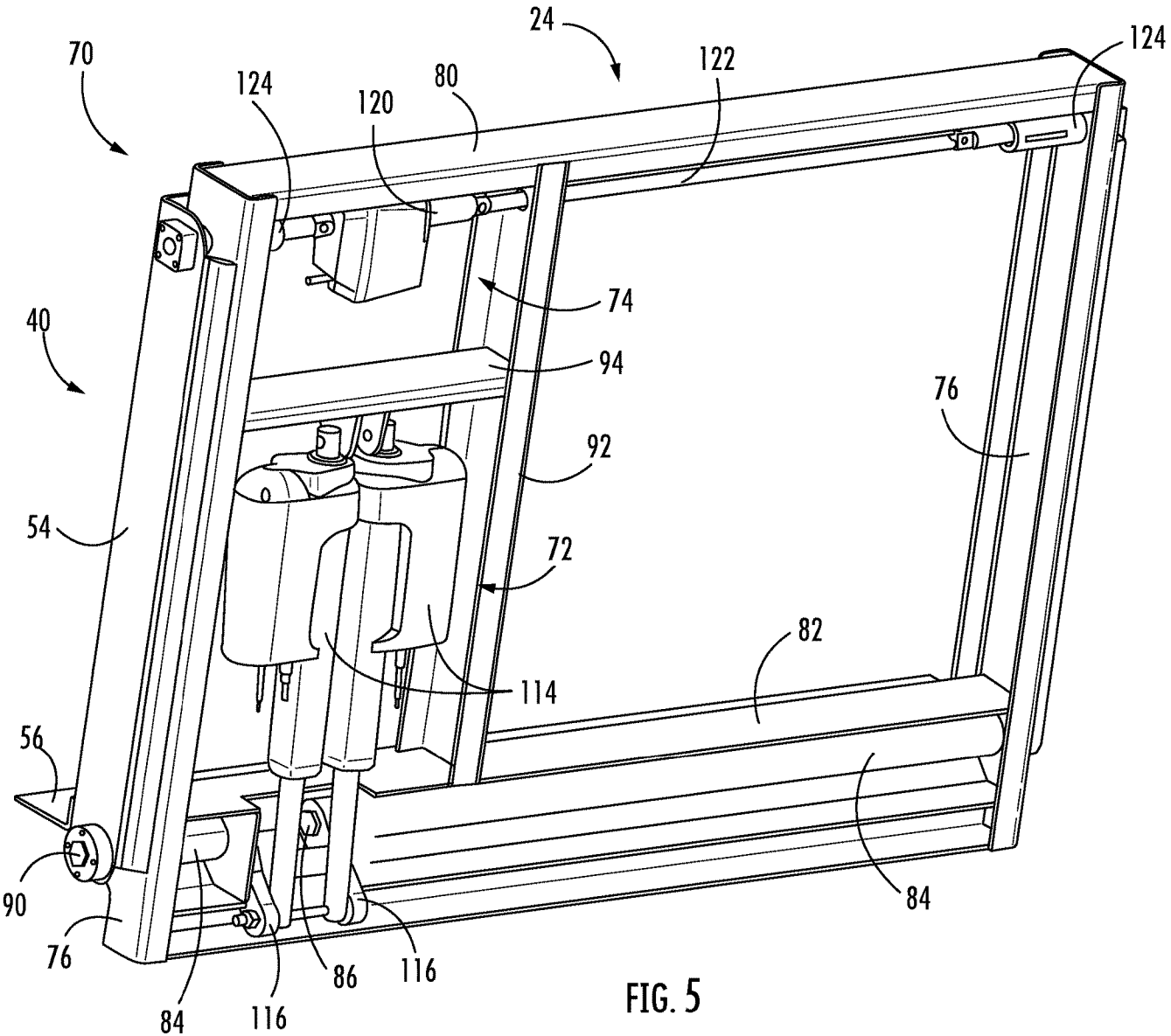
FIG. 5 is a perspective view of a door frame and an aperture frame of the folding bulwark assembly of FIG. 1, with the adjacent deck and hull structures and a door skin removed to show frame details, and with the door frame closed.
Figure 6:
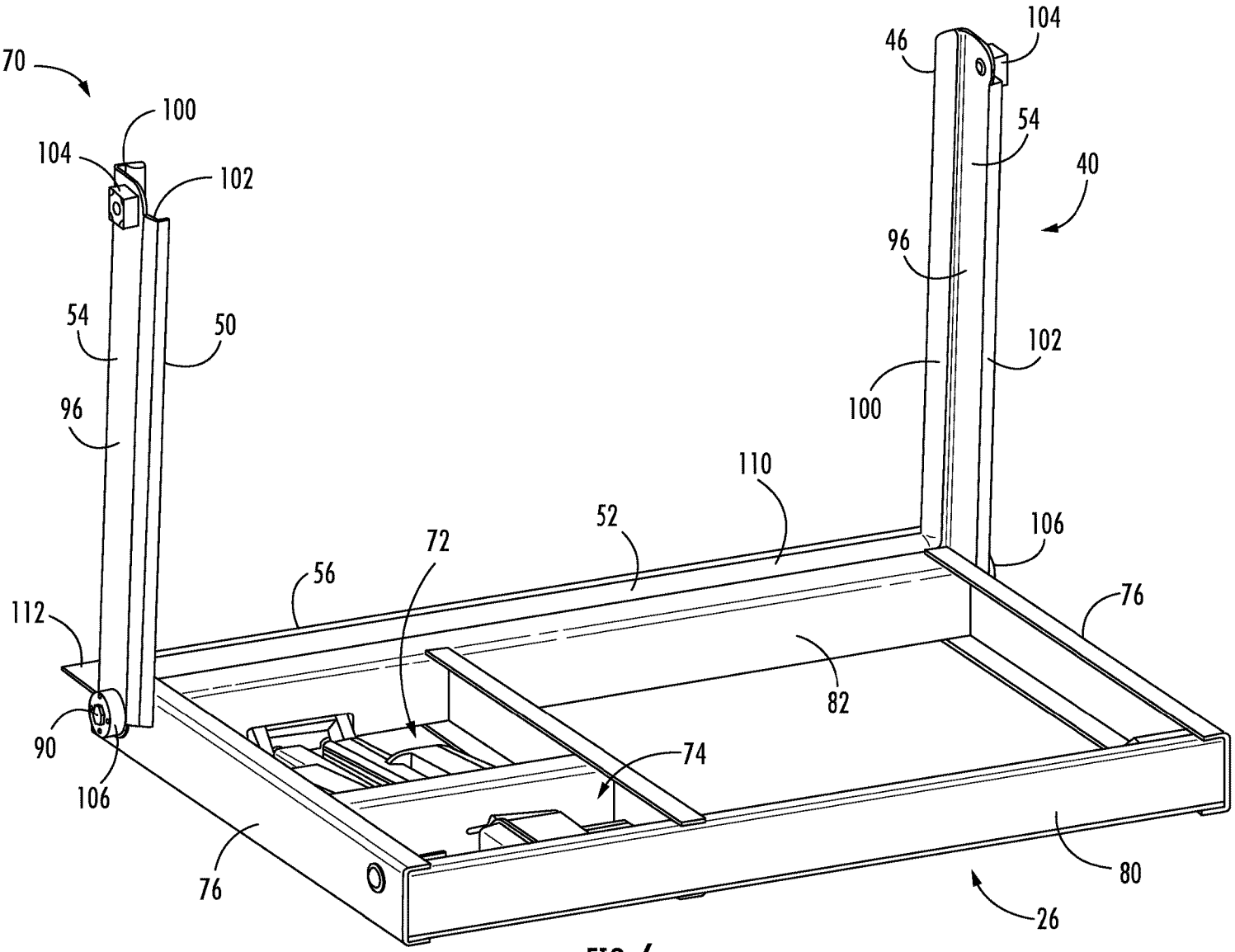
FIG. 6 is a perspective view of the folding bulwark frame and aperture frame of FIG. 5, with the door frame folded down.

The bulwark door 12 includes a door skin 22 mounted over a door frame 24 (see also FIGS. 5 and 6). The door skin 22 includes the inner surface 16, outer surface 26 and side surfaces 28. With the door 12 closed, the outer surface 26 matches the contour of the adjacent hull surface 30 (which, in the context of this application, should be understood to include adjacent superstructure surfaces, as applicable depending on the marine vessel configuration) and the side surfaces 28 are hidden. Preferably, a periphery of the outer surface 26 extends beyond the side surfaces 28, resulting in lips 32 around each side surface 28.

The bulwark aperture 14 is defined by opposite aperture sides 34 and an aperture sill 36 at the level of the adjacent deck 20. An aperture frame 40 (see also FIGS. 5 and 6) is mounted to the aperture sides 34 and sill 36. An aperture cavity 42 is defined under the sill 36 to accommodate movement of a door bottom portion 44 between the closed and folded down positions.

Aperture seals 46, 50, 52 are mounted extending along the sides 34 and sill 36 of the aperture for creating a seal between the door 12 and the aperture 14 in both the closed and folded down positions, as will be explained in greater detail below with additional reference to FIGS. 3 and 4. The aperture seals 46, 50 are inner and outer side seals and are attached to side members 54 of the aperture frame 40, while the aperture seal 52 is a bottom seal and is attached to a sill member 56 of the aperture frame 40. With the door 12 closed, the inner side seals 46 engage the inner surface 16 of the door skin 22. The outer side seals 46 respectively engage the side surfaces 26 of the door skin 22.

Figure 3:
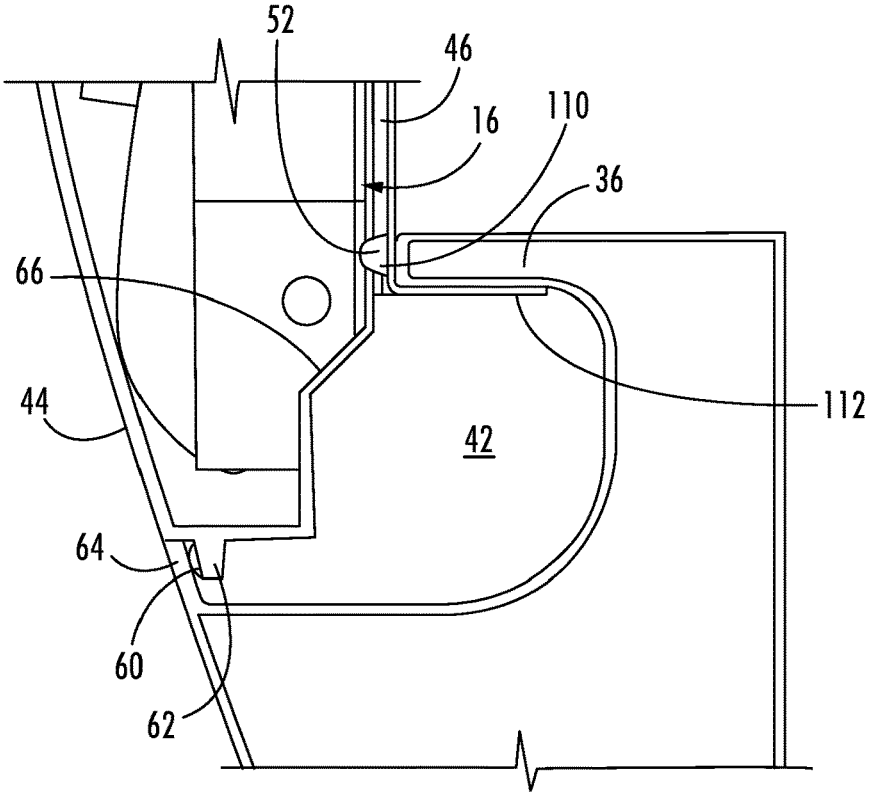
FIG. 3 is a detail sectional view of an interface between a bottom of the door of FIG. 1 and adjacent deck and hull structures, with the door closed.
Figure 4:
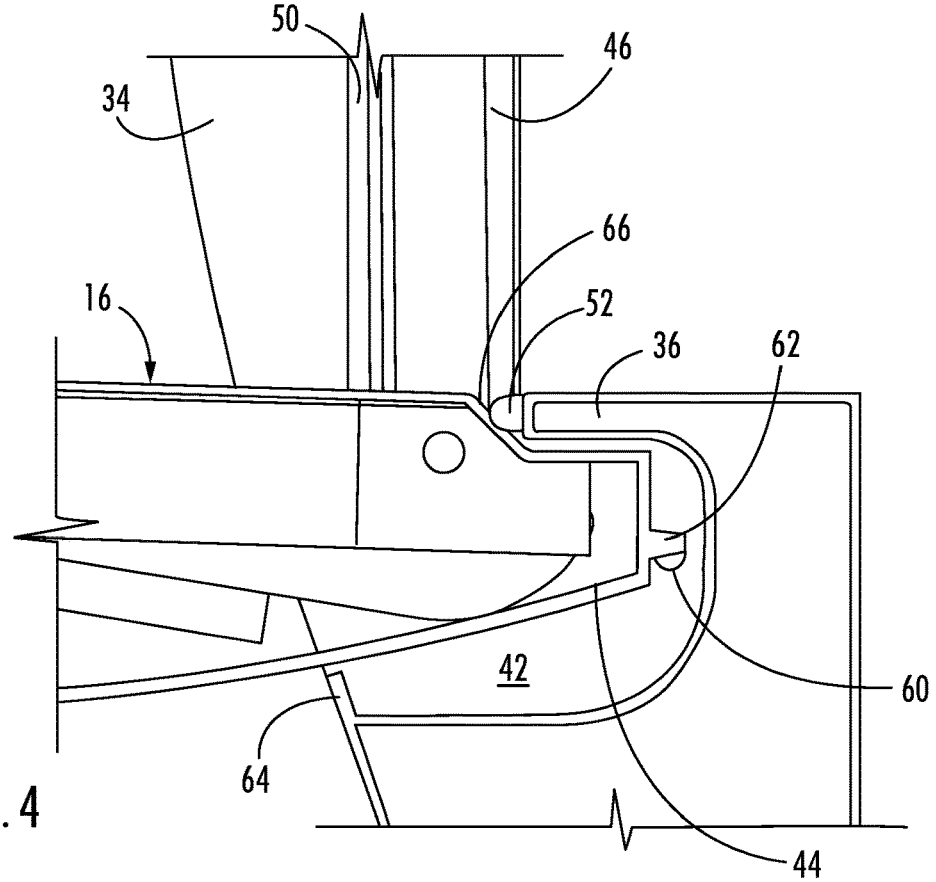
FIG. 4 is a detail sectional view of the interface between the bottom of the door of FIG. 1 and adjacent deck and hull structures with the door folded down.

Referring to FIGS. 3 and 4, a door bottom seal 60 is attached to a bottom lip 62 extending along the door bottom portion 44 and engages a cavity lip 64 extending along an outer edge of the aperture cavity 42 with the door 12 closed. The bottom aperture seal 52 engages the inner surface 16 of the door skin 22. With the door 12 closed there are consequently two layers of seals between both the sides and the bottom of the door 12 and aperture 14 to prevent water intrusion. With the door 12 open, the aperture bottom seal 52 engages an angled transition portion 66 of the door skin 22.

Referring to FIGS. 5 and 6, a frame arrangement 70 includes the door frame 24 and the aperture frame 40. The door frame 24 is pivotably connected to the aperture frame 40 and pivoted relative thereto via a door actuation mechanism 72. The door frame 24 is also lockable to the aperture frame 40 via a door locking mechanism 74.

The door frame 24 includes side frame members 76 connected by upper and lower cross frame members 80, 82. The side frame members 76 and the lower cross frame member 82 connect to a split hinge barrel 84. The hinge barrel 84 surrounds, and is pivotable relative to, a split hinge shaft 86 extending therethrough. Ends 90 of the hinge shaft 86 extend through the side members 54 of the aperture frame 40 and are not pivotable relative thereto. Advantageously, the outer ends 90 of the hinge shaft 86 are retractable to facilitate installation, as will be explained below. One or more intermediate frame members 92 extend between the upper and lower cross frame members 80, 82, parallel with the side frame members 76. An actuator mounting member 94 connects between one of the side frame members 76 and the intermediate frame member 92.

The aperture frame 40 includes the side members 54 with the sill member 56 connected therebetween. The side members 54 and sill member 56 are preferably connected to the aperture sides 34 and sill 36 using structural adhesives and mechanical fasteners such as screws.

The side members 54 each include a base member 96 which lies flat along its respective aperture 34 and inner and outer angled edges 100, 102. The inner edge 100 extends perpendicularly from the base member 96 into the aperture 14 and carries the inner side seal 46 on its outer surface. The outer angled edge 102 extends at an obtuse angle from the base member 96 and carries the outer side seal 50 along its outer end.

Hinge shaft and lock mechanism receptacles 104, 106 adjoin the inner face of each base member 96 and are received in openings formed in the structure of the opposite aperture sides 34 to reinforce the reception points of the hinge shaft 86 and door locking mechanism 74. Additional reinforcement can be incorporated into the aperture sides 34 and/or sill 36, such as reinforcement plates laminated into the adjacent fiberglass structure, as desired or dictated by a given installation.

The sill member 56 is L-shaped with a vertical portion 110 and a horizontal portion 112. The vertical portion 110 is connected between inner surfaces of the inner angled edges 100 of the side members 54 and carries the bottom aperture seal 52. The horizontal portion 112 extends under and reinforces the aperture sill 36 (see also FIG. 3).

In the depicted embodiment, the door actuation mechanism 72 includes one or more linear actuators 114 mounted at one end to the actuator mounting member 94 and engaging the split hinge shaft 86 via a pair of linkage arms 116, such as tiller arms. Since the ends of the hinge shaft 86 are held stationary by the aperture frame side members 54 and hinge shaft receptacles 104, retraction of the actuators 114 from their extended position (as in FIG. 5) to their retracted position (as in FIG. 6) will result in pivoting the door frame 24 from the closed position to the folded down position. Advantageously, the depicted actuation mechanism 72 can be easily accessed for inspection or service via removal of all or a portion of the inner surface 16 of the door 12.

The depicted actuators are electrical linear actuators, but it will be appreciated that other actuators could be employed. For instance, linear electrical actuators could be replaced with linear hydraulic actuators, as might be preferred for larger doors. Additionally, features of the present invention could still be utilized in connection with externally actuated doors, as well as with different types of internal and/or external actuators, such as rotary actuators. The employed actuators can be programmable and remotely operable and provide remote indication of door position.

The door locking mechanism 74 includes a linear actuator 120 connected in-line with a locking shaft 122. The locking shaft 122 and actuator 120 "float" within the door frame 24, with opposite ends being slidably supported in barrels 124 connected to the door side frame members 76 and passing through an opening in the intermediate frame member 92. Outward and inward movement of the opposite ends is delimited by engagement with slots 126 in the barrels 124. When the actuator 120 extends, one end of the shaft 122 will move until fully extended and engaged with the outer end of its respective slot 126. Further extension of the actuator 120 will then cause the other end to move outward until full extension in both directions is reached and the door 12 is fully locked. Retraction of the actuator 120 will function in reverse to fully retract one end of the shaft 122 and then the other.

This door locking mechanism advantageously avoids the need for dual actuators or additional gearing and/or other linkages to drive locking shafts in opposite directions using a single actuator, as well as being easily accessible through the inner surface 16 of the door 12. However, it will be appreciated that features of the present invention could be used in connection with other manual or automatic locking mechanisms. For instance, externally actuated manual or automatic locks (such as linear or rotary solenoid-actuated locks) could be utilized which extended into receptacles in the door. It will also be appreciated that the door locking mechanism can be remotely controlled and provide remote indication of lock status.

To install the folding bulwark assembly 10, once the aperture 14 is formed, the aperture frame 40 is installed, with the side members 54 providing accurate references for where the openings for hinge shaft and lock mechanism receptacles 104, 106 must be formed. The door skin 22 is attached to the door frame 24 and the entire door is installed with the outer ends 90 of the hinge shaft 86 retracted until aligned with the hinge shaft receptacles 104. Once any control and power connections are made to the door actuation and locking mechanisms 72, 74, the folding bulwark assembly 10 is ready to operate.

In general, the foregoing embodiments are described for illustrative and exemplary purposes; the present invention is not necessarily limited thereto. Rather, those skilled in the art will appreciate that various modifications, as well as adaptations to particular circumstances, will fall within the scope of the invention as herein shown and described and of the claims appended hereto.

What is claimed is:

1. A folding bulwark assembly comprising:

a bulwark door including:

a door frame including side door frame members connected by upper and lower cross door frame members;

a door skin mounted on the door frame;

a hinge shaft pivotably mounted to the door frame proximate the lower cross door frame member and having hinge shaft ends extending through the side door frame members;

a door actuation mechanism mounted to the door frame within the door skin and operable to pivot the door frame around the hinge shaft to move the bulwark door between a closed position and a folded down position; and a door locking mechanism mounted to the door frame and having a locking shaft with at least a first locking shaft end extendable and retractable from a first of the side door frame members and a locking actuator operable to extend and retract the at least one locking shaft end; and an aperture frame including aperture frame side members and a sill member connected therebetween, each of the aperture frame side members including a hinge shaft receptable receiving a respective one of the hinge shaft ends and at least one of the aperture frame side members including a lock mechanism receptable receiving the at least one locking shaft end with the bulwark door in the closed position.

2. The assembly of claim 1, wherein the bulwark door further includes a hinge barrel fixed to the door frame, the hinge barrel pivotably accommodating the hinge shaft.

3. The assembly of claim 2, wherein the hinge shaft is non-pivotably received in the hinge shaft receptables and the door actuation mechanism includes at least one linear actuator movable between extended and retracted positions and having a first actuator end connected to the door frame and a second actuator end connected to the hinge shaft by a linkage arm, retraction of the linear actuator from the extended position causing the hinge barrel and the door frame to pivot around the hinge shaft.

4. The assembly of claim 3, wherein the hinge shaft and the hinge barrel are both split and the second actuator ends connects to the hinge shaft by the linkage arm in the split.

5. The assembly of claim 3, wherein at least one of the hinge shaft ends is retractable to facilitate installation and removal of the bulwark door.

6. The assembly of claim 3, wherein the door actuation mechanism further includes another linear actuator.

7. The assembly of claim 1, wherein the locking shaft has a second locking shaft end extendable and retractable from a second of the side door frame members, the locking actuator being a linear actuator operable to extend and retract both the first and second locking shaft ends.

8. The assembly of claim 7, wherein the locking shaft and the locking actuator float with the door frame with the first and second locking shaft ends being slidably supported in barrels connected to the first and second side door frame members.

9. The assembly of claim 1, wherein the sill member is L-shaped with a vertical portion and a horizontal portion, the vertical portion being attached to the aperture frame side members and an underside of the horizontal portion engaging a bottom portion of the bulwark door in the folded down position.

10. The assembly of claim 9, further comprising aperture side seals attached to each of the aperture frame side members and an aperture bottom seal attached to the vertical portion of the sill member between aperture frame side members.

11. The assembly of claim 10, wherein the aperture side seals include inner and outer aperture side seals attached to each of the aperture frame side members.

12. The assembly of claim 11, wherein, with the bulwark door in the closed position, the inner aperture side seals and the aperture bottom seal engage an inner surface of the door skin and the outer aperture side seals engage respective side surfaces of the door skin.

13. The assembly of claim 12, wherein a bottom lip extends along the door bottom portion and a door bottom seal is attached to the door bottom lip and faces outward with the bulwark door in the closed position.

14. A folding bulwark assembly comprising:

a hull surface having a bulwark aperture defined therein; and a bulwark door pivotably mounted in the bulwark aperture by a hinge shaft, the bulwark door including at least one linear actuator located therein and engaging the hinge shaft, the at least one linear actuator being extendable and retractable to move the bulwark door between a closed position and a folded down position.

15. The folding bulwark assembly of claim 14, further comprising:

an aperture frame including aperture frame side members and a sill member connected therebetween, each of the aperture frame side members including a hinge shaft receptable receiving a respective end of the hinge shaft.

16. The folding bulwark assembly of claim 15, wherein the respective ends of the hinge shaft are non-pivotably received in the hinge shaft receptables and the bulwark door includes a hinge barrel pivotably accommodating the hinge shaft.

17. The folding bulwark assembly of claim 15, wherein an aperture cavity is defined under a sill of the bulwark aperture accommodating movement a bottom portion of the bulwark between the closed and folded down positions.

18. The folding bulwark assembly of claim 17, wherein the sill member is L-shaped with a vertical portion and a horizontal portion, the vertical portion being attached to the aperture frame side members and an underside of the horizontal portion engaging a bottom portion of the bulwark door in the folded down position and reinforcing the sill of the bulwark aperture.

19. The folding bulwark assembly of claim 15, wherein the bulwark door further includes a door locking mechanism mounted to the door frame and having a locking shaft with at least a first locking shaft end extendable and retractable from a first of the side door frame members and a locking actuator operable to extend and retract the at least one locking shaft end.

20. The assembly of claim 19, wherein the locking shaft has a second locking shaft end extendable and retractable from a second of the side door frame members, the locking actuator being a linear actuator operable to extend and retract both the first and second locking shaft ends.

21. The assembly of claim 20, wherein the locking shaft and the locking actuator float with the door frame with the first and second locking shaft ends being slidably supported in barrels connected to the first and second side door frame members.

22. The assembly of claim 14, wherein the bulwark door includes a door frame including side door frame members connected by upper and lower cross door frame members and a door skin mounted on the door frame.

* * * * *